United States Patent [19]

Wells

[11] 3,968,278

[45] July 6, 1976

[54] IMAGING METHOD

[75] Inventor: John B. Wells, Savannah, N.Y.

[73] Assignee: Xerox Corporation, Stamford, Conn.

[22] Filed: May 28, 1974

[21] Appl. No.: 473,623

[52] U.S. Cl. ..... 427/258; 260/824 R; 260/824 EP; 427/288

[51] Int. Cl.[2] ..... B41M 5/00

[58] Field of Search..... 117/38, 161 UZ, 161 ZA; 260/824, 827; 101/137, 426, 337; 252/62.1; 427/256, 258, 288

[56] References Cited

UNITED STATES PATENTS

| | | | |
|---|---|---|---|
| 3,187,031 | 6/1965 | Weyenberg | 252/78 X |
| 3,553,133 | 1/1971 | Olson | 260/827 X |
| 3,760,030 | 9/1973 | Dean | 260/827 |

OTHER PUBLICATIONS

I and EC Research and Development, vol. 10, p. 10, (Mar., 1971).

Macromolecules, vol. 3, p. 1, (Jan. – Feb., 1970).

*Primary Examiner*—Thomas J. Herbert, Jr.
*Assistant Examiner*—Bruce H. Hess
*Attorney, Agent, or Firm*—James J. Ralebate; James P. O'Sullivan; Jerome L. Jeffers

[57] ABSTRACT

Disclosed is a method of duplicating and imaged master comprised of a marking material distributed in an imagewise manner upon a substrate. The method involves contacting the master with a highly viscoelastic inking composition comprising:

a. a silicon containing block copolymer having polymeric silicone segments and polymeric segments of a material which is adhesive to the material comprising the image;

b. a coloring agent; and c. a solvent in which the copolymer is soluble but which is a non-solvent for the marking material. The inked master is then contacted under pressure with a transfer member to thereby transfer the ink to the transfer member in imagewise configuration.

8 Claims, No Drawings

IMAGING METHOD

BACKGROUND OF THE INVENTION

The art of xerography, as disclosed in U.S. Pat. No. 2,297,691 to C. F. Carlson, involves the formation of a latent electrostatic image on a photoconductive substrate with subsequent development by use of a particulate electroscopic marking material known as toner. The toner is normally comprised of a thermoplastic resin which can be thermally fused so as to provide a permanent image. The toner can be fused directly to the photoconductive substrate as in the case of coated paper xerography or transferred to and fused to paper as in the case of plain paper xerography. The relative ease with which such an electrostatographic copy can be made has led researchers to look for methods whereby the copy can be used as a master for duplicating more of its kind.

The use of a xerographic plate as a lithographic master has been disclosed in U.S. Pat. No. 3,460,476. In this process, an electrostatic latent image is formed on the surface of a hydrophilic glass photoconductive plate and developed with a hydrophobic toner. Lithographic ink and a fountain solution are then applied to the plate whereby the ink will conform to the hydrophobic image in an imagewise configuration. Contacting the inked surface with a transfer sheet will then affect the transfer of the image on the master to the transfer sheet.

The above-described system is effective for making a large number of copies from an easily prepared lithographic master. However, the process is less desirable when only a few copies are needed due to the cost involved in preparing the master. In addition, this method requires the use of a fountain solution in conjunction with the lithographic ink. The use of a separate lithographic ink and fountain solution has proven problematical since such a process requires the sequential application of water and ink each time a print is made, and this repeated operation decreases the useful life of the plate. Trouble is also encountered through partial comingling or emulsification of the oil and water on the plate.

One of the proposed methods for overcoming some of the defects of conventional lithographic processes has been the use of water-in-oil emulsion inks. However, emulsion inks suggested for use in lithography generally suffer from certain drawbacks which have not made their use particularly feasible. Some such inks do not have the capacity to remain in an emulsive state, that is, they have a tendency to demulsify or break in the ink fountain or during storage. Others do not provide satisfactory prints, particularly where a large number of copies are to be produced.

It would be desirable and it is an object of the present invention to provide a method and composition for the duplication of original documents comprised of marking material dispersed in an imagewise manner upon a substrate.

An additional object is to provide such a composition and method which can be used to duplicate an image comprised of an organic polymeric marking material on a substrate.

A further object is to provide such a method whereby the master is prepared by electrostatographic imaging and the marking material is comprised of a thermoplastic resin and a pigment.

An additional object is to provide such a method in which a plain or coated paper xerographic copy can be used as a lithographic master.

A further object is to provide such a process in which no fountain solution is required.

SUMMARY OF THE INVENTION

The present invention is a method and composition for duplicating a master comprised of a marking material distributed in an imagewise manner upon a substrate. The method involves:

a. contacting the imaged master with a highly viscoelastic inking composition comprising:

1. A silicon containing block copolymer having polymeric silicone segments and polymeric segments of a material which is adhesive to the marking material;
2. a coloring agent; and d. a solvent in which the silicon containing copolymer is soluble but which is a non-solvent for the marking material; and b. contacting under pressure the inked, image bearing substrate with a transfer member to thereby transfer the ink from the image bearing substrate to the transfer member in an imagewise configuration corresponding to the image on the master.

Also included within the scope of the invention is the above-described inking composition.

DETAILED DESCRIPTION

The marking material can be distributed on the substrate by a number of methods. For example, it can be encased in microcapsules which, when ruptured by the impact of a typewriter key, will release the material in the desired configuration. It can also be distributed by conventional printing or lithographic techniques. A preferred method is to prepare the master by electrostatographic imaging as previously described. In this embodiment, the marking material, normally referred to as toner, is a thermoplastic organic resin which is applied to the substrate and permanently fixed thereto such as by heat fusing. The toner will normally contain a pigment, such as carbon black, to render it visible, although the presence of a pigment in the toner is not essential to the practice of the present invention. The organic resin used in the toner is selected from those materials which are adherent to the non-silicon portions of the copolymer. Examples of resins which have been used or suggested for use in toners include gum copal, gum sandarac, rosin, coumaroneindene resin, asphaltum, gilsonite, phenol-formaldehyde resins, rosin-modified phenol-formaldehyde resins, methacrylic resins, polystyrene resins, polypropylene resins, epoxy resins, polyethylene resins and mixtures or copolymers thereof.

A particularly useful class of toners contain finely divided particles of a copolymer of butyl methacrylate copolymerized with styrene or a styrene homologue of the formula:

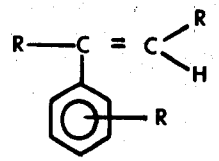

where R is hydrogen or lower alkyl.

The adhesive segment of the block copolymer is prepared from those monomeric materials which are attracted to the marking material, which will in most instances contain a thermoplastic resin as in the case of toner. Since like materials tend to adhere to each other, the adhesive portion of the black copolymer is preferably made up of the same monomeric material which comprises the resin of the toner. For example, if the toner was comprised of a polyethylene, a copolymer of siloxane segments and polyethylene segments would preferably be used. Likewise, if the toner was comprised of poly ($\alpha$-methyl styrene) a block copolymer of a siloxane and $\alpha$-methyl styrene would be preferred. Of course, the resin in the toner and that in the copolymer need not be the same. The only criteria is that they be adhesive to each other. Thus, in duplicating an image formed from a marking material comprised of an epoxy type resin, one would select a silicon containing copolymer in which the nonsilicon containing segments were adhesive to the epoxy resin. A copolymer containing styrene or $\alpha$-methyl styrene would not be used due to the lack of adhesion between epoxies and styrenes.

The substrate may be of any material which has the physical integrity to support the image and to which the copolymer is essentially abhesive. It is critical to the present invention that the substrate be less adhesive to the silicon containing copolymer than the image forming material. Thus, while it is permissible for a small amount of the inking composition to adhere to the substrate, the materials must be selected so that there is a substantial difference between the amount which adheres to the substrate and that which adheres to the marking material in order to avoid an undue amount of background development. Suitable substrates include, for example, glass, aluminum, brass, chromium, zinc or a ceramic material. Polymeric film substrates such as a Mylar can be used provided that the marking material is of a composition which is substantially more adhesive to the copolymer than is the polymer of the film. Electrostatographic copies made on paper coated with a photoconductive inorganic pigment dispersed in an insulating resin matrix can be used. Here again, the insulating resin matrix must be substantially less adhesive to the silicon containing copolymer than is the marking material. A preferred substrate is plain paper; thus copies made by the well known plain paper electrostatographic process are preferred for use as duplicating masters in the present invention.

Once the master is prepared, it is uniformly contacted with the ink, such as by use of a roller. Since the ink is essentially non-adhesive to the substrate but is adhesive to the marking material, it will be distributed in an imagewise configuration conforming to the configuration of the marking material. For direct printing, the inked surface is then contacted with a transfer sheet, normally under pressure, to thereby affect the transfer of copies of the image to the transfer sheet. Since the copies will necessarily appear as the mirror image of the image on the master, the master should contain an image which is a mirror of what is desired. The process may also be used in offset printing where the image is transferred to a printing blanket prior to transfer to paper.

The ink comprises three basic ingredients; the silicon containing block copolymer, the pigment and the solvent.

Silicon containing polymers which can be employed in the invention include block copolymers and graft copolymers in which the non-silicon containing segment is grafted to the backbone of a polysiloxane. Particularly useful silicon containing block copolymers include the tri-block or multi-block copolymers having a silicon phase of the type which have linear sequences of one monomer species followed by a linear sequence of the second monomer unit. The tri-block copolymer refers to a polymer of the type generically represented by the formula (ABA) in which A and B comprise the respective segments of the copolymer with B representing the siloxane portion and A representing the nonsilicon containing portion. On the other hand, the multi-block copolymer may be generically represented by the formula $(AB)_n$ in which A and B again comprise the respective segments involved. In the present situation, one of the segments comprises a polysiloxane, i.e. silicone, phase and the other comprises a composition which is adhesive to the marking material. The block copolymers have an organopolysiloxane phase and a nonsilicon phase which may be selected from a variety of materials. The organopolysiloxane phase can be represented by the general formula:

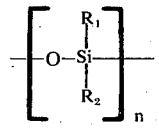

wherein $R_1$ and $R_2$ are monovalent organic moieties which may be the same or different and $n$ is a number representing the degree of polymerization. Examples of $R_1$ and $R_2$ include alkyl radicals, saturated aliphatic radicals, cyanoalkyl radicals and halogenated aryl radicals. The nonsilicone phase of the copolymer may be selected from a variety of materials such as polystyrene, poly ($\alpha$-methyl styrene), polyesters, polyamides, polyurethanes and polycarbonates. Copolymers which are suitable for use in the present invention are not intended to be limited by the type of nonsilicone phase contained therein. silicone containing block copolymers and methods for their preparation are more fully described in U.S. Pat. No. 3,187,031 and 3,760,030. Preferred block copolymers are those which contain a weight ratio of between about 95 to 50 parts of the silicone phase to about 5 to 50 parts of the nonsilicone phase.

Particularly preferred block copolymers having a silicone phase include the tri-block and multi-block copolymers of an organopolysiloxane with polystyrene or poly($\alpha$-methylstyrene). Copolymers of this type and methods for their preparation are described in I + EC Product Research and Development, Volume 10, page 10, (March, 1971) and Macromolecules, Volume 3, page 1, (January – February, 1970), respectively.

The nature of the coloring agent, i.e. pigment or dye, is not critical provided it provides the necessary opacity to the ink and consists of a material which is compatible with the silicon containing block copolymer. Suitable coloring agents are those compositions which are compatible with the silicon containing block copolymer and will increase its optical density so as to render it visible. Thus, carbon black or other minutely divided carbonaceous pigments may be employed. Other organic and inorganic pigments and dyes may be employed such as for example, titanium dioxide, zinc oxide, lithopone, magnesium silicate, China clays, complex aluminum silicates, barium sulfate, iron oxide red pigments, cadmium reds, nickel titanate, iron blues, benzidine yellows, toluidine reds, copper phthalocyanine blue, thioindigo pigments, anthraquinone pigments, alkali blue, Congo Red, Diazo Blue, Benzo Fast Blue and Chrysophenine Y. The amount of coloring agent is not critical since the only requirement is that it provide the desired degree of opacity. Typical ink compositions will contain from 15 to 30 weight percent of the pigment or dye being employed.

The solvent is selected from those organic liquids which will dissolve the block copolymer in combination with the coloring agent, but which are non-solvents for the image forming material. Since the image forming material is fixed to the substrate and thereby less readily dissolved than it would be in particulate form, selection of an appropriate solvent is not problematical. Typical solvents include, kerosene, acetone, mixtures of liquid aromatic and aliphatic liquids, chlorinated hydrocarbons such as methylene chloride, trichloroethylene, perchloroethylene and methyl chloroform as well as the commercially available organic ink vehicles. Routine experimentation may be required to match up the best solvent with the colored copolymer and image forming material being employed. In general, sufficient solvent is employed to give the ink the consistency of a thick paste or putty which can be applied to the duplicating master with an ink roller and provide an ink having sufficiently high viscoelasticity. It is essential that the ink have a high viscoelasticity so that when it is rolled onto the master and the master contacted with the receiving member it will separate intact from the background areas but will split in the image areas to thereby transfer to the receiving member only in the image bearing areas. Inks which have been successfully used in the method of the invention have had adhesive properties such that no meaningful viscosity or tack measurements can be made on conventional inkometers or viscometers. A person skilled in the art who seeks to produce a particular ink useful in the invention will realize that it may be necessary to conduct a few trials in order to prepare an ink having sufficiently high viscoelasticity so that when the inked master is contacted with the transfer member the ink will transfer in imagewise configuration.

In a preferred embodiment, organic resins and/or plasticizers are added to the ink to improve its rheological properties. The additive resin can be selected from those compositions which will enhance the ink's adhesion to the image forming material. Examples of such resins include ethylene glycol or glycerol esters of hydrogenated rosins, polyterpenes, terpene phenols and zinc resinates. Plasticizers which may be used include phthalates, phosphates, and adipates, e.g. tricresyl phosphate or dioctyl phthalate.

The method of practicing the present invention is further illustrated by the following examples.

EXAMPLE I

An inking composition is prepared in accordance with the present invention which comprises on a weight basis:

a. 23.1% of a 90/10 block copolymer of dimethylsiloxane and $\alpha$-methylstyrene of the form $(AB)_n$. The copolymer has a molecular weight of about 237,000 with the $\alpha$-methylstyrene segments having a molecular weight of about 6600 to provide a multi-block polymer corresponding to the foregoing formula in which $n$ is about 3.

b. 23% carbon black pigment; and c. 30.8% of a naphthenic ink vehicle sold under the trademark Circosol No. 304 by the Sun Oil Company.

In addition to the essential ingredients, 7.7% of an ester of triethylene glycol and caprylic acid having a molecular weight of approximately 406 sold under the trademark Ruccoflux TG8 by the Hooker Chemical Company is added as plasticizer and 15.3% of a glycerol ester of hydrogenated rosin having an acid number of 6 sold under the trademark Stabylite Ester Gum No. 5 by The Hercules Corporation is added to enhance the rheological properties and adhesive characteristics of the ink.

The ink is heated, stirred and placed on a 3 roll mill. An ink film is spread on a glass plate and removed by a soft rubber brayer roller. The roller is passed over the surface of an electrostatograpic copy having an image on its surface of toner material containing poly($\alpha$-methyl styrene). The ink adheres to the toner material but not to the paper substrate. Five background free legible copies are made by laying a paper transfer sheet over the inked master and applying pressure with a roller. This is the case since sufficient ink adheres to the toner so as to be removable but little if any ink adheres to the background.

EXAMPLE II

The ink prepared as in Example I is spread on an electrostatographic copy of paper having an image on its surface comprised of an image forming material containing a 65/35 copolymer of styrene and n-butyl methacrylate. Legible, background free copies are obtained from this master by contacting the inked surface with plain paper under pressure as previously described.

EXAMPLE III

A duplicating master is prepared by electrostatographically imaging a film of Mylar with marking material containing a 65/35 copolymer of styrene and n-butyl methacrylate. The master is inked with the composition described in Example I and used to make legible, background free copies as previously described.

EXAMPLE IV

The experiment described in Example III is repeated except that an aluminum plate is used as the substrate. Legible, background free copies are prepared as before.

EXAMPLE V

The experiment described in Example I is repeated except that a master comprising marking material containing a styrene/butadiene copolymer on a Mylar substrate is prepared by electrostatographic means. Legible, background free copies are prepared by inking the master and transferring the ink in imagewise configuration as previously described.

EXAMPLE VI

An electrostatographic master is prepared on a paper substrate using an epoxy resin based toner material. The master is inked with the composition described in Example I. It is found that copies cannot be prepared from this master due to the lack of adhesion between the epoxy resin and the non-silicone phase of α-methylstyrene in the copolymer used in the ink.

EXAMPLE VII

The experiment described in Example I is repeated except that the concentration of the block copolymer in the ink is reduced by half. The ink does not transfer to the receiving member, i.e. paper, due to the reduction in viscoelasticity caused by using less block copolymer in the formulation.

EXAMPLE VIII

The experiment of Example I is repeated except that a 60/40 multi-block copolymer of dimethylsiloxane and α-methylstyrene is used. The block copolymer has a molecular weight of approximately 126,000 with the α-methylstyrene segments having molecular weights of approximately 8000. Legible, background free copies are prepared as previously described.

EXAMPLE IX

The experiment of Example VIII is repeated with the exception that the 60/40 block copolymer has a molecular weight of about 22,900 with the α-methylstyrene portions having molecular weights of about 4600. It is discovered that this ink is not sufficiently high in viscoelasticity to be useful in the present invention.

What is claimed is:

1. A method of duplicating a master comprised of a thermoplastic organic resin as marking material distributed in an imagewise manner upon a substrate which comprises:

a. contacting the image bearing substrate with a highly viscoelastic inking composition comprised of:

1. a silicon containing block copolymer having siloxane segments and polymeric segments of a material which is adhesive to the marking material, said siloxane segments being characterized by the formula:

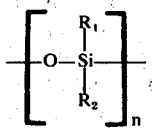

in which $R_1$ and $R_2$ are monovalent organic moieties which may be the same or different and $n$ is a number representing the degree of polymerization;

2. a coloring material; and 3. a solvent in which the silicon containing block copolymer is soluble but which is a non-solvent for the organic marking material; and b. contacting under pressure the inked, image bearing substrate with a transfer member to thereby transfer ink from the image bearing substrate to the transfer member in an imagewise configuration corresponding to the image on the master.

2. The method of claim 1 wherein the resin is gum copal, gum sandarac, rosin, coumaroneindene resin, asphaltum, gilsonite, a phenol-formaldehyde resin, a rosin-modified phenol formaldehyde resin, a methacrylate resin, an epoxy resin, a polyethylene resin or a mixture thereof.

3. The method of claim 1 wherein the resin is a copolymer of butyl methacrylate copolymerized with styrene or a styrene homologue of the formula:

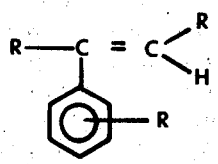

where R is hydrogen or lower alkyl.

4. The method of claim 1 wherein the marking material is distributed on a paper substrate by electrostatographic means.

5. The method of claim 1 wherein the silicon containing copolymer is a tri-block or multi-block copolymer having a linear sequence of an organopolysiloxane followed by a linear sequence of a nonsilicone phase.

6. The method of claim 5 wherein the nonsilicone phase of the block copolymer is polystyrene poly(α-methylstyrene), a polyester, a polyamide, a polyurethane, or a polycarbonate.

7. The method of claim 5 wherein the block copolymer contains a weight ratio of between about 95 to 50 parts of the silicone phase to about 5 to 50 parts of the nonsilicone phase.

8. The method of claim 1 wherein the marking material contains poly(α-methyl styrene) and the copolymer is a block copolymer of dimethylpolysiloxane and poly(α-methyl styrene).

* * * * *

UNITED STATES PATENT AND TRADEMARK OFFICE

CERTIFICATE OF CORRECTION

PATENT NO. : 3,968,278

DATED : July 6, 1976

INVENTOR(S) : John B. Wells

It is certified that error appears in the above-identified patent and that said Letters Patent are hereby corrected as shown below:

In the Abstract, line 1, "and" should be corrected to read --an--.

Column 2, line 19, "d." should be corrected to read --3.--.

Column 3, line 7, "black" should be corrected to read --block--.

Column 4, line 46, "silicone" should be corrected to read --Silicone--.

Signed and Sealed this

Twelfth Day of October 1976

[SEAL]

*Attest:*

RUTH C. MASON
*Attesting Officer*

C. MARSHALL DANN
*Commissioner of Patents and Trademarks*